US007590368B2

(12) United States Patent
Kamijo et al.

(10) Patent No.: US 7,590,368 B2
(45) Date of Patent: Sep. 15, 2009

(54) IMAGE FORMING APPARATUS AND METHOD OF CLEANING INTERMEDIATE TRANSFER BELT

(75) Inventors: Koichi Kamijo, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 402 days.

(21) Appl. No.: 11/564,235

(22) Filed: Nov. 28, 2006

(65) Prior Publication Data

US 2007/0122181 A1 May 31, 2007

(30) Foreign Application Priority Data

Nov. 28, 2005 (JP) ..... 2005-341936
Nov. 28, 2005 (JP) ..... 2005-341937
Nov. 28, 2005 (JP) ..... 2005-341938

(51) Int. Cl.
*G03G 15/16* (2006.01)
*G03G 21/00* (2006.01)

(52) U.S. Cl. ..... 399/101; 399/348

(58) Field of Classification Search ..... 399/99, 399/101, 297, 346, 348
See application file for complete search history.

(56) References Cited

U.S. PATENT DOCUMENTS 6,347,212 B1 * 2/2002 Kosugi et al. ..... 399/348
7,010,259 B2 * 3/2006 Gila et al. ..... 399/348
7,039,353 B2 * 5/2006 Yamada et al. ..... 399/101 X
2004/0234309 A1 * 11/2004 Nagata et al. ..... 399/348

FOREIGN PATENT DOCUMENTS

JP 2002-189354 7/2002

* cited by examiner

*Primary Examiner*—Sandra L Brase
(74) *Attorney, Agent, or Firm*—Hogan & Hartson LLP

(57) ABSTRACT

An image forming apparatus includes an intermediate transfer belt that has an elastic layer to which a toner image on an image carrier developed using a liquid developer is primarily transferred, a cleaning roller that cleans an extraneous material remaining on the intermediate transfer belt after secondary transfer, and a coating member that coats the intermediate transfer belt with a cleaning liquid.

3 Claims, 5 Drawing Sheets

IMAGE FORMING APPARATUS AND METHOD OF CLEANING INTERMEDIATE TRANSFER BELT

CROSS REFERENCES

This application claims priority from Japanese Patent Application No. 2005-341936 filed on Nov. 28, 2005, Japanese Patent Application No. 2005-341937 filed on Nov. 28, 2005, and Japanese Patent Application No. 2005-341938 filed on Nov. 28, 2005, the entire contents of which are incorporated herein by reference.

BACKGROUND

1. Technical Field

The present invention relates to a method of cleaning an intermediate transfer belt using a liquid developer and to an image forming apparatus.

2. Related Art

An electrophotographic image forming apparatus (a wet type image forming apparatus) using a liquid developer is known in the art. A developer that is used in the wet type image forming apparatus is formed by suspending solids (toner particles) in an electrical insulating organic solvent (a carrier liquid). In this case, the particle size of the toner particle is a very fine, for example, 2 μm or less and typically, 1 μm or less. Therefore, the wet type image forming apparatus can realize high image quality compared with a dry type image forming apparatus that uses fine toner particles having a size of approximately 7 μm.

The carrier liquid constituting the developer prevents the toner particles having a size of approximately 1 μm from being scattered, charges the toner particles, and uniformly disperses the toner particles. In addition, the carrier liquid enables the toner particles to easily move by an electric field effect during a developing process or a transfer process. As described above, the carrier liquid is a component required during a toner preservation process, a toner feed process, a development process, and a transfer process. However, the carrier liquid may be stuck to a non-image region, and an excess carrier liquid after the development may cause transfer dispersion. For this reason, the carrier liquid is typically removed (squeezed) with respect to the developer on a photosensitive member or an intermediate transfer member. Additionally, in the wet type image forming apparatus, when a secondary transfer belt or an intermediate transfer belt is used, the liquid developer (the carrier liquid and the solids) that is stuck to the surface of the belt is removed by a cleaning blade (for example, see JP-A-2002-189354).

However, since the an extraneous material (the liquid developer) that is cleaned from the intermediate transfer belt is typically subject to carrier removal in the above-described manner, a ratio of the solids is increased, and the solids are stuck to the surface of the intermediate transfer belt like 'wet powder'. After the transfer to the paper, the carrier liquid is absorbed from the developer that remains on the intermediate transfer belt into the paper. Then, a stronger force is required to perform cleaning due to the increased ratio of the solids. Therefore, as regards a soft belt (having low elasticity), the surface of the belt is deformed by the cleaning blade, which causes damage to the belt.

SUMMARY

An advantage of some aspects of the invention is that it enables cleaning of a liquid developer stuck onto an intermediate transfer belt of an image forming apparatus using the liquid developer to be performed without causing damage to the belt.

According to an aspect of the invention, an image forming apparatus includes an intermediate transfer belt that has an elastic layer to which a toner image on an image carrier developed by a liquid developer is primarily transferred, a cleaning roller that cleans an extraneous material remaining on the intermediate transfer belt after secondary transfer, and a coating member that coats the intermediate transfer belt with a cleaning liquid.

According to another aspect of the invention, a method of cleaning an intermediate transfer belt includes coating the intermediate transfer belt having an elastic layer using a cleaning liquid, and bringing a cleaning roller into contact with the intermediate transfer belt to clean an extraneous material remaining on the intermediate transfer belt after secondary transfer.

According to the aspects of the invention, since the cleaning liquid is coated on the intermediate transfer belt and the cleaning roller is brought into contact with the intermediate transfer belt so as to perform cleaning, it is possible to perform cleaning without causing damage to the soft intermediate transfer belt.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
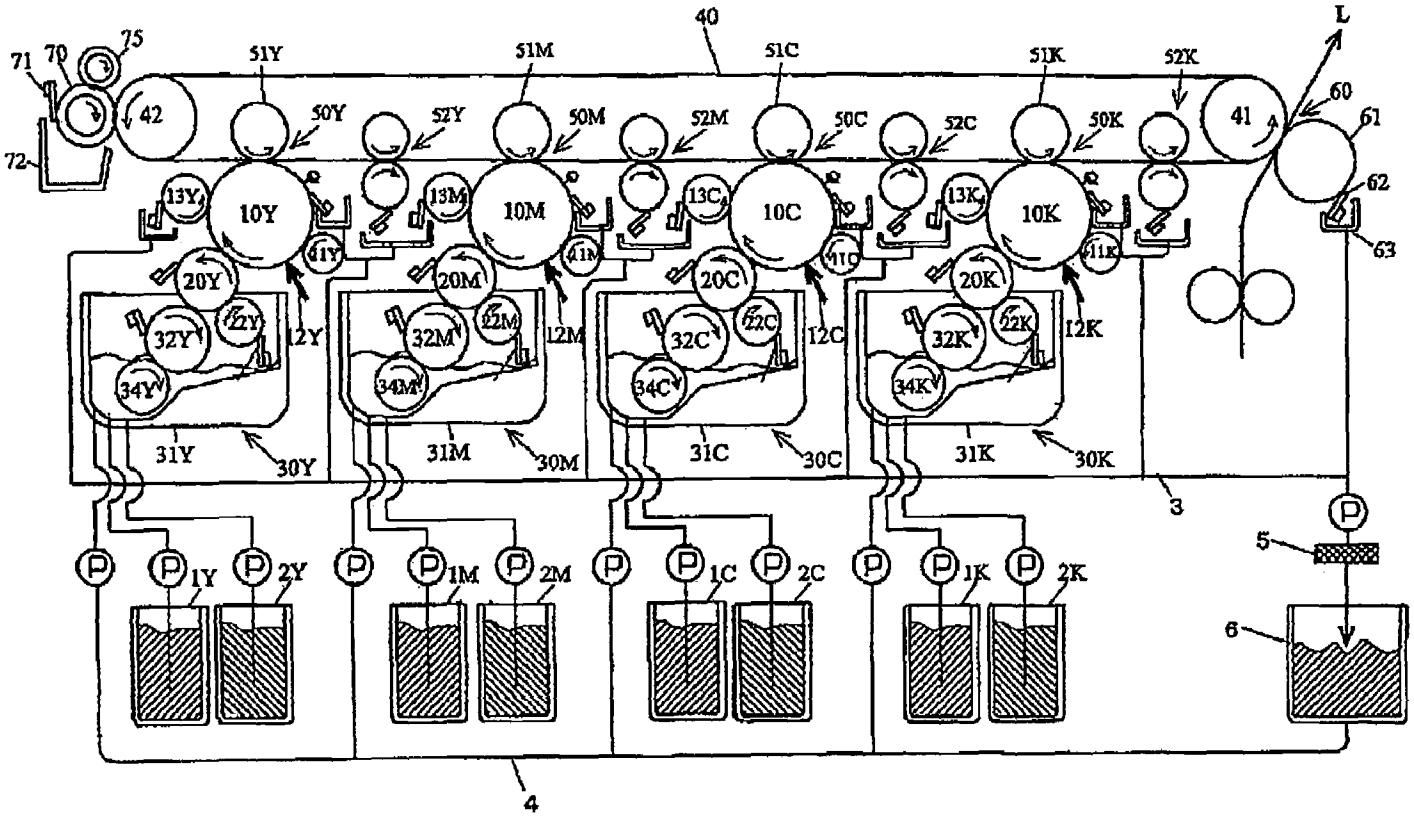
FIG. 1 is a diagram illustrating the overall structure of an image forming apparatus according to an embodiment of the invention.

Embodiments of the invention will now be described with reference to the drawings. FIG. 1 is a diagram showing main parts of an image forming apparatus according to an embodiment of the invention. With respect to image forming portions having different colors that are disposed at the center of the image forming apparatus, developing units 30Y, 30M, 30C, and 30K are disposed at a lower portion of the image forming apparatus, and an intermediate transfer belt 40 and a secondary transfer unit 60 are disposed at an upper portion of the image forming apparatus.

The image forming portions have image carriers 10Y, 10M, 10C, and 10K, charging rollers 11Y, 11M, 11C, and 11K, and exposure units 12Y, 12M, 12C, and 12K (not shown), respectively. Each of the exposure units 12Y, 12M, 12C, and 12K has optical systems, such as a semiconductor laser, a polygon mirror, and an F-θ lens. In addition, the image carriers 10Y, 10M, 10C, and 10K are uniformly charged by the charging rollers 11Y, 11M, 11C, and 11K. Subsequently, a laser beam modulated on the basis of an input image signal is irradiated by the exposure units 12Y, 12M, 12C, and 12K and then electrostatic latent images are formed on the charged image carriers 10Y, 10M, 10C, and 10K.

The developing units 30Y, 30M, 30C, and 30K in brief have developing rollers 20Y, 20M, 20C, and 20K, developer reservoirs 31Y, 31M, 31C, and 31K that store liquid developers having colors of yellow (Y), magenta (M), cyan (C), and black (K), and developer supply rollers 32Y, 32M, 32C, and 32K that supply the liquid developers for the individual colors from the developer reservoirs 31Y, 31M, 31C, and 31K to the developing rollers 20Y, 20M, 20C, and 20K, respectively. In addition, the developing units 30Y, 30M, 30C, and 30K develop the electrostatic latent images formed on the image carriers 10Y, 10M, 10C, and 10K by the liquid developers for the individual colors.

The intermediate transfer belt 40 is an endless elastic belt member and wound around a driving roller 41 and a tension roller 42 to be tightly stretched therebetween. The intermediate transfer belt 40 is rotated by the driving roller 41 while coming into contact with the image carriers 10Y, 10M, 10C, and 10K at primary transfer units 50Y, 50M, 50C, and 50K. In the primary transfer units 50Y, 50M, 50C, and 50K, primary transfer rollers 51Y, 51M, 51C, and 51K are disposed to face the image carriers 10Y, 10M, 10C, and 10K with the intermediate transfer belt 40 interposed therebetween. Contact positions to the image carriers 10Y, 10M, 10C, and 10K are primary transfer positions. The toner images of the individual colors on the developed image carriers 10Y, 10M, 10C, and 10K are sequentially transferred onto the intermediate transfer belt 40 to overlap one another, thereby forming a full color toner image.

As described above, the toner images that are formed on a plurality of image carriers (photosensitive members) 10 are sequentially primarily transferred onto the intermediate transfer belt 40 to overlap one another. The overlap toner images are secondarily transferred on a sheet material at the same time. In the secondary transfer process, a surface of the sheet material may not be flat due to fibroid materials. In the invention, even though the above-mentioned sheet material is used, a soft elastic belt member is used as a unit for improving secondary transfer characteristics along the surface of an uneven sheet material.

Figure 2:
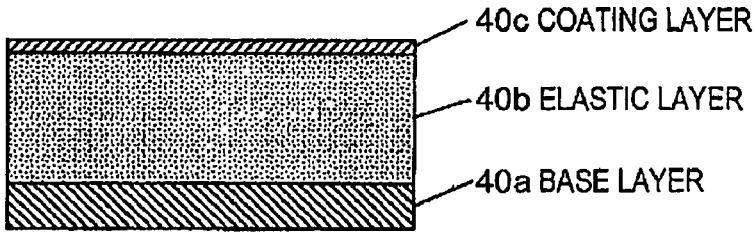
FIG. 2 is a diagram illustrating the structure of an intermediate transfer belt.

The structure of the intermediate transfer belt will be described with reference to FIG. 2.

The intermediate transfer belt 40 has a base layer 40*a* (for example, a thickness 100 μm) formed of a polyimide material or the like that has excellent bending durability, low stretch against belt tension, and excellent heat resistance during a heat treatment in a coating process of coating an elastic layer, urethane rubber (hardness JIS-A30°) or the like. The intermediate transfer belt 40 has three layers of the base layer 40*a*, an elastic layer 40*b* (for example, a thickness 200 μm) that covers a surface of the base layer 40*a*, and a coating layer 40*c* (for example, a thickness 10 μm) formed of fluorine resin. The image is formed on the coating layer 40*c* by primary transfer. In addition, a width of the intermediate transfer belt is 324 mm, and a volume resistance value of the belt is approximately log 10 Ωcm (a resistance value of all layers).

In the secondary transfer unit 60 of FIG. 1, a secondary transfer roller 61 faces a belt driving roller 41 with the intermediate transfer belt 40 interposed therebetween, and a cleaning device having a secondary transfer roller cleaning blade 62 and a developer recovery unit 63 is disposed In the secondary transfer unit 60, the sheet material, such as paper, film, or cloth, is fed and supplied through a sheet material feed path L according to a timing at which a full color toner image or a monochrome toner image formed on the intermediate transfer belt 40 approaches a transfer position of the secondary transfer unit 60, and the monochrome toner image or the full color toner image is secondarily transferred to the sheet material. A fixing unit (not shown) is disposed in front of the sheet material feed path L, and the monochrome toner image or the full color toner image transferred to the sheet material is fused on and fixed to a recording medium (sheet material), such as paper, thereby completing the image formation on the sheet material. The secondary transfer roller 61 is an elastic roller formed by coating a surface with an elastic member as a unit for improving a secondary transfer characteristic along the uneven surface of the sheet material due to fibroid materials. This has the same purpose as an elastic belt member used for the intermediate transfer belt 40 in which the toner images formed on a plurality of image carriers 10 are sequentially primarily transferred to and carried on the intermediate transfer belt 40 to overlap one another, and then secondarily transferred to the sheet material at the same time.

Figure 3:
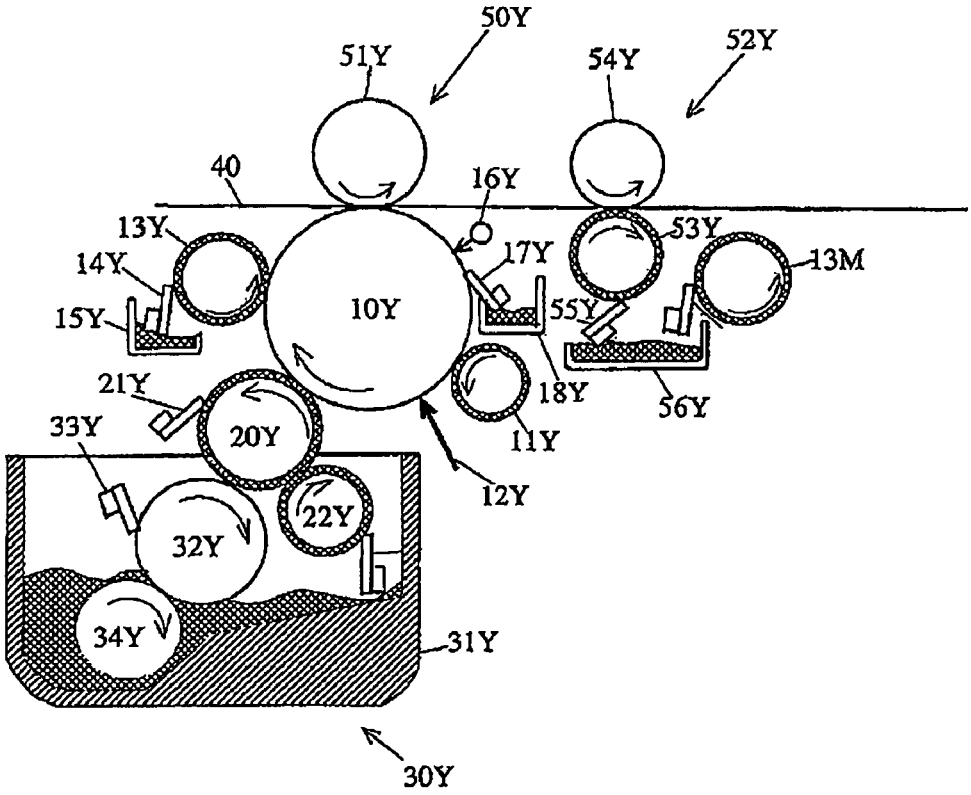
FIG. 3 is a diagram showing main parts of an image forming portion and a developing unit.

Next, the image forming portion and the developing unit will be described. FIG. 3 is a cross-sectional view showing main parts of the image forming portion and the developing unit. The structures of the image forming portions and the developing units for the individual colors are the same, and thus a description will be given for the image forming portion and the developing unit for yellow (Y).

In the image forming portion, a cleaning device having a latent image eraser 16Y, an image carrier cleaning blade 17Y, and a developer recovery portion 18Y, a charging roller 11Y, an exposure unit 12Y, a developing roller 20Y of a developing unit 30Y, and an additional cleaning device having an image carrier squeeze roller 13Y, an image carrier squeeze roller cleaning blade 14Y as an attachment of the image carrier squeeze roller 13Y, and a developer recovery portion 15Y are disposed along a rotation direction of the circumference of the image carrier 10Y. In the developing unit 30Y, a cleaning blade 21Y, a developer supply roller 32Y using an anilox roller, and a pressing roller 22Y are disposed on the circumference of the developing roller 20Y, and a liquid developer agitation roller 34Y and a developer supply roller 32Y are provided in the liquid developer reservoir 31Y.

In addition, the primary transfer roller 51Y of the primary transfer unit is disposed along the intermediate transfer belt 40 to face the image carrier 10Y. An intermediate transfer belt squeeze device 52Y that includes an intermediate transfer belt squeeze roller 53Y, a backup roller 54Y, an intermediate transfer belt squeeze roller cleaning blade 55Y, and a developer recovery portion 56Y is disposed on a downstream side of a movement direction of the intermediate transfer belt.

Figure 4:
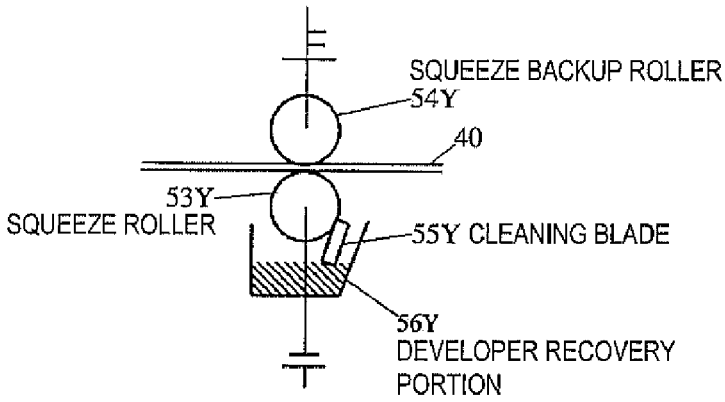
FIG. 4 is a diagram illustrating a squeeze device of the intermediate transfer belt.

FIG. 4 is a diagram illustrating the squeeze device 52Y. The squeeze device 52Y is provided between the individual colors of the intermediate transfer belt, and the squeeze roller 53Y is provided to remove the carrier liquid contained in the liquid developer on the intermediate transfer belt 40 and rotates at the same speed as the intermediate transfer belt. The squeeze roller 53Y is formed by winding a PFA tube of 20 μm around urethane rubber (hardness JIS-A30°) surface layer having a thickness of 2 mm (an outer diameter ϕ 14 mm) on a metal shaft of ϕ 10 mm, and a width of the roller is 307 mm. The squeeze roller 53Y is disposed to face the squeeze backup roller 54Y (a metal shaft of ϕ 10 mm) with the intermediate transfer belt 40 interposed therebetween, and comes into contact with the intermediate transfer belt at a linear pressure of approximately 50 gf/cm. A resistance value of the roller is approximately log 4 Ω, and a bias voltage of +150 V is applied between the squeeze roller 53Y and the squeeze backup roller 54Y such that the solids in the developer are not removed. The squeeze roller 54Y comes into contact with the cleaning blade 55Y formed of urethane rubber (hardness JIS-A70°) so as to be cleaned. With the above-mentioned structure, the carrier liquid of the liquid developer is squeezed from the intermediate transfer belt 40 and then collected in the developer recovery portion 56Y.

The width of the image carrier 10Y is larger than the width of the developing roller 20Y, that is, approximately 320 mm. The image carrier 10Y is a photoreceptor drum formed of a cylindrical member having a photosensitive layer formed on the circumference thereof. For example, as shown in FIG. 3, the image carrier 10Y rotates in a clockwise direction. The photosensitive layer of the image carrier 10Y is formed of an organic image carrier or an amorphous silicon image carrier member. The charging roller 11Y is disposed on an upstream side of a rotation direction of the image carrier 10Y from a nip portion between the image carrier 10Y and the developing roller 20Y. A bias having the same polarity as the charging polarity of the developed toner particle is applied from a power supply device (not shown) to the image carrier 10Y so as to charge the image carrier 10Y. The exposure unit 12Y is provided on the downstream side of the rotation direction of the image carrier 10Y from the charging roller 11Y, and irradiates a laser beam onto the image carrier 10Y charged by the charging roller 11Y so as to form the latent image on the image carrier 10Y.

The developing unit 30Y has the developer reservoir 31Y that stores the liquid developer, in which 25 wt % of the toner is dispersed in the carrier liquid, the developing roller 20Y that carries the liquid developer thereon, the developer supply roller 32Y, a regulating blade 33Y, and an agitation roller 34Y that agitate the liquid developer and supply the liquid developer to the developing roller 20Y while the liquid developer is uniformly dispersed, the pressing roller 22Y that presses the liquid developer carried on the developing roller 20Y (film formation), and the developing roller cleaning blade 21Y that cleans the developing roller 20Y.

The liquid developer that is contained in the developer reservoir 31Y is not a known volatile liquid developer that has a low concentration (approximately 1 to 2 wt %), low viscosity, and volatility at a normal temperature, and uses Isopar (Trademark: Exxon) as a carrier liquid, but a nonvolatile liquid developer that has a high concentration, high viscosity, and nonvolatility at a normal temperature. That is, in the liquid developer according to the embodiment of the invention, the solids that have a mean particle size of 1 μm and in which a coloring agent, such as a pigment, is dispersed on thermoplastic resin are added to a liquid solvent, such as an organic solvent, silicon oil, mineral oil, or edible oil, together with a dispersing agent, In this case, the concentration of the toner solid is approximately 25%. Thus, viscosity is high (approximately 30 to 10000 mPa·s).

The developer supply roller 32Y is a cylindrical member, and rotates, for example, in a clockwise direction, as shown in FIG. 3. The developer supply 32Y is an anilox roller, on a surface of which has an uneven surface including fine and uniform spiral grooves, such that the developer is easily carried on the surface of the anilox roller. As regards the size of the groove, the groove pitch is approximately 130 μm and the depth of the groove is approximately 30 μm. The liquid developer is supplied from the developer reservoir 31Y to the developing roller 20Y by the developer supply roller 32Y. The agitation roller 34Y and the developer supply roller 32Y may be provided to slide with respect to each other or may be separated from each other.

The regulating blade 33Y has an elastic blade formed by coating its surface with an elastic member, a rubber portion formed of urethane rubber coming into contact with the surface of the developer supply roller 32Y, and a plate formed of a metal so as to support the rubber portion. In addition, the regulating blade 33Y regulates and controls the film thickness and the amount of the liquid developer carried on the developer supply roller 32Y formed of the anilox roller, and also controls the amount of liquid developer supplied to the developing roller 20Y. Further, the rotation direction of the developer supply roller 32Y may be opposite to the direction of an arrow shown in FIG. 3. In this case, the regulating blade 33Y is disposed to correspond to the rotation direction.

The developing roller 20Y is a cylindrical member having a width of approximately 320 mm, and rotates in a counterclockwise direction around a rotational shaft, as shown in FIG. 3. In the developing roller 20Y, an elastic layer formed of polyurethane rubber, silicon rubber, NBR or the like is provided around the circumference of an internal core formed of a metal, such as iron. The developing roller cleaning blade 21Y is formed of rubber or the like that comes into contact with the surface of the developing roller 20Y, and is disposed on a downstream side of the rotation direction of the developing roller 20Y from the developing nip portion where the developing roller 20Y comes into contact with the image carrier 10Y so as to remove the liquid developer remaining on the developing roller 20Y.

Returning to FIG. 1, carrier oil is supplied from carrier cartridges 1Y, 1M, 1C, and 1K, to the developer reservoirs 31Y, 31M, 31C, and 31K, and the developer is supplied from developer cartridges 2Y, 2M, 2C, and 2K to the developer reservoirs 31Y, 31M, 31C, and 31K. Meanwhile, the developer (primarily containing the carrier liquid) that is squeezed from the squeeze rollers 13Y, 13M, 13C, and 13K of the image carriers for the individual colors, and the developer (primarily containing the carrier liquid) that is squeezed from intermediate transfer belt squeeze units 52Y, 52M, 52C, and 52K are fed through a developer feed path 3 to a filter 5 according to a pump reaction. Additionally, the developer (primarily containing the carrier liquid) that is recovered from the secondary transfer roller cleaning blade 62 and then collected in the developer recovery portion 63, or paper dust is fed through the developer feed path to the filter 5 according to the pump reaction. The solid or the paper dust is removed from the filter 5, and the carrier liquid is pooled in a carrier buffer tank 6 so as to prevent the colors from being mixed, and fed through a carrier feed path 4 to the developer reservoirs 31Y, 31M, 31C, and 31K. Of course, the carrier liquid may be supplied to the carrier cartridges.

In the invention, a cleaning roller 70 that tightly stretches the intermediate transfer belt 40 along the belt driving roller 41 is disposed along the circumference of the belt cleaning backup roller 42 to face the belt driving roller 41 and to come into contact with the intermediate transfer belt 40. A cleaning blade 71 and a developer recovery reservoir 72 are disposed around the cleaning roller 70, and a cleaning liquid coating member 75 is disposed to face the roller (the secondary transfer roller 41 of FIG. 1) that tightly stretches the intermediate transfer belt, thereby easily removing the developer (the carrier liquid and the solids) that are stuck to the surface of the intermediate transfer belt. Embodiments thereof will be described with reference to FIGS. 5 and 6.

Figure 5:
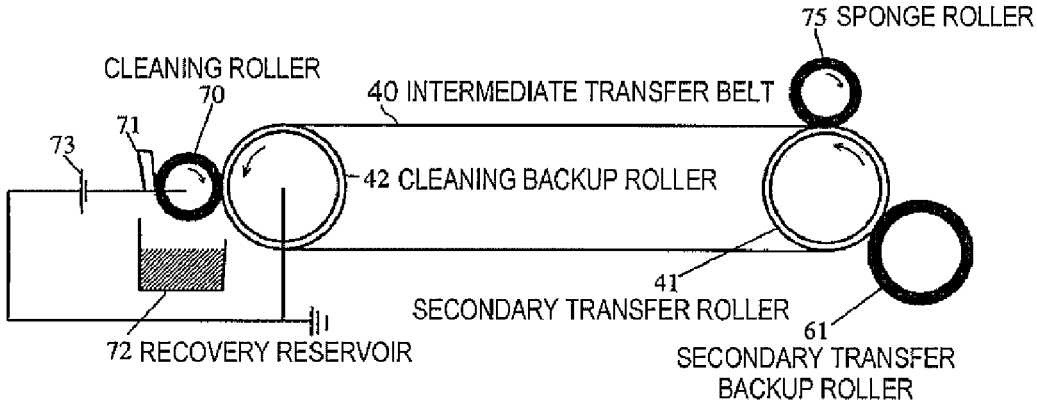
FIG. 5 is a diagram illustrating a first embodiment.

FIG. 5 is a diagram illustrating a first embodiment. In the first embodiment, a sponge roller is used as the cleaning liquid coating member 75, and a bias voltage is applied between the cleaning roller 70 and the cleaning backup roller 42.

As described above, the intermediate transfer belt 40 is an endless elastic belt member, and is tightly stretched between the secondary transfer roller 41 also serving as the driving roller and the cleaning backup roller 42 also serving as the tension roller. As regards the extraneous material (the liquid developer) that remains on the intermediate transfer belt after secondary transfer, since the carrier liquid is removed from the squeeze rollers after primary transfer and the carrier liquid is absorbed into the transfer member during secondary transfer, the solid ratio increase, and thus a stronger force is required to perform cleaning. Accordingly, in the first embodiment, a sponge roller 75 is disposed as the cleaning liquid coating member so as to easily coat the cleaning liquid and to face the secondary transfer roller 41, the liquid is coated on the intermediate transfer belt, and the cleaning roller, not the cleaning blade, is used to prevent damage to the intermediate transfer belt. In addition, any liquid including water or the carrier liquid may be used insofar as it can reduce the solid ratio.

The sponge roller that is a liquid coating member is formed by winding a sponge (Asker A, hardness 40°) having a thickness of 5 mm (outer diameter ϕ 20 mm) and being formed of urethane around the metal shaft of ϕ 10 mm. The sponge roller has the same peripheral velocity as the intermediate transfer belt 40, and the rotation direction is the progress direction of rotation. However, the sponge roller is not limited thereto. The width of the roller is 310 mm, and the roller slightly comes into contact with the intermediate transfer belt at a linear pressure of approximately 50 gf/cm. In addition, when the sponge roller is set to have a speed of approximately 1.2 times as high as the peripheral velocity of the belt, scraping effect by the sponge roller is assured. Therefore, cleaning may be easily performed.

The cleaning roller 70 that is disposed to face the cleaning backup roller 42 with the intermediate transfer belt 40 interposed therebetween has a diameter of 25 mm and includes a cored bar of 20 mm. 2.5 mm urethane rubber having hardness of JIS-A30° is wound around the cored bar, and a urethane coat of approximately 100 μm and 85 degrees is formed. The width of the roller is 310 mm. The cleaning roller 70 has the same speed as the intermediate transfer belt 40, and is driven in the rotation direction. A resistance value of the cleaning roller is, for example, log 4 Ω, and a bias voltage of approximately 400 V is applied from a power supply 73 to the cleaning roller to attract the charged solids from the coated liquid, thereby achieving excellent belt cleaning. In addition, when surface tension of the surface layer of the intermediate transfer belt is 20 dyne/cm and surface tension of urethane of the surface layer of the cleaning roller is 40 dyne/cm, since an adherence to the cleaning roller increases in view of a surface property, excellent cleaning is achieved. However, the cleaning roller is not limited thereto. The cleaning roller may be formed of a tube that is wound by a fluorine coating layer or a PFA tube, instead of the urethane coat.

The blade 71 that cleans the cleaning roller 70 has a width of 317 mm, and the urethane roller 70 comes into contact with a blade having hardness of JIS-A90° (thickness 2 mm and free length 6.5 mm) in a counter direction with respect to the rotation direction of the roller, thereby performing cleaning. Since hardness of the blade is high, blade cleaning of the cleaning roller can be performed. A contact angle is not particularly limited. For example, when the contact occurs under the total load of 1 kgf at 30°, excellent cleaning is achieved and the developer that is used for cleaning is collected in the recovery reservoir 72.

Figure 6:
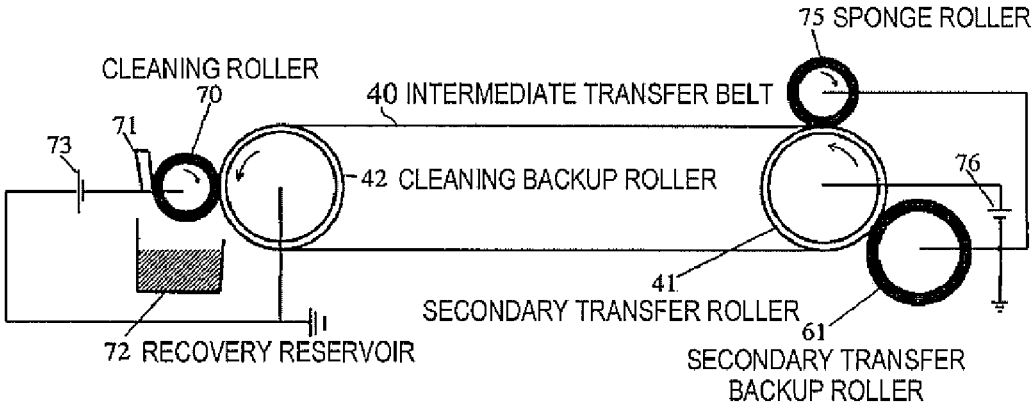
FIG. 6 is a diagram illustrating a second embodiment.

FIG. 6 is a diagram illustrating a second embodiment. In the second embodiment, a bias voltage is applied between the sponge roller also serving as the cleaning solution coating member and the secondary transfer roller.

The second embodiment is the same as the first embodiment shown in FIG. 5, except that the bias voltage is applied between the sponge roller and the secondary transfer roller.

In the second embodiment, in order to float the solids stuck to the intermediate transfer belt 40, the bias voltage is applied to the sponge roller 75, thereby attracting the solids from the intermediate transfer belt. In this case, a transfer current needs to flow through the secondary transfer backup roller, through which a transfer material (paper) passes. For this reason, particularly, since resistance of the paper is high, when the resistance value of the sponge roller is Rs and the resistance value of the secondary transfer backup roller is Rt, Rs needs to be higher than Rt. In the second embodiment, Rs is set to log 6 Ω and Rt is set to log 4 Ω.

Moreover, in the embodiments of FIGS. 5 and 6, the cleaning liquid coating member is disposed to face the secondary transfer backup roller, but the invention is not limited thereto. The cleaning liquid coating member may be disposed to face an additional roller that can tightly stretch the intermediate transfer belt. In this case, like the embodiment of FIG. 6, when the bias voltage is applied to the sponge roller, Rs may be set to log 4 to log 8 Ω, and preferably, log 6 Ω.

Figure 7:
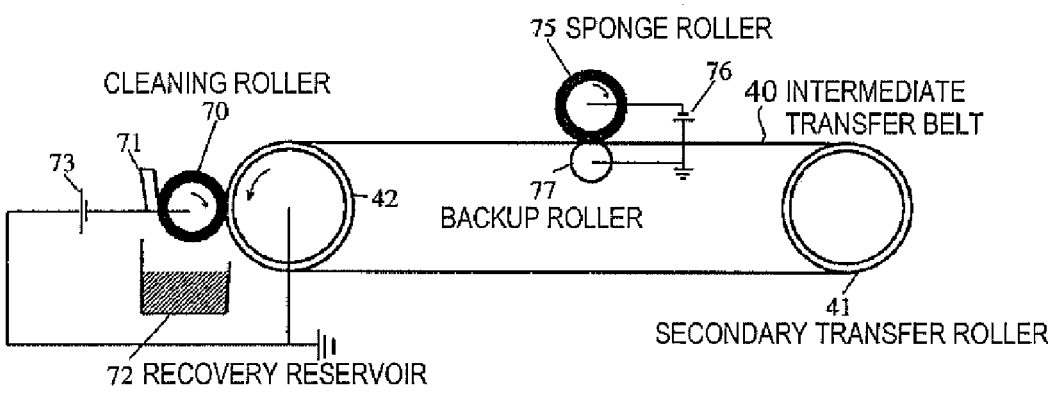
FIG. 7 is a diagram illustrating a third embodiment.

FIG. 7 is a diagram illustrating a third embodiment. In the third embodiment, the sponge roller also serving as the cleaning liquid coating member 75, the backup roller, and the rollers that tightly stretch the intermediate transfer belt are disposed.

As described above, the intermediate transfer belt 40 is an endless elastic belt member and tightly stretched between the secondary transfer roller 41 also serving as the driving roller and the cleaning backup roller 42 also serving as the tension roller. After the secondary transfer, as regards the extraneous material (the liquid developer) that remains on the intermediate transfer belt, since the carrier liquid is removed from the squeeze rollers after the primary transfer and the carrier liquid is absorbed into the transfer member during the secondary transfer, the solid ratio increases. Thus, a strong force is required to perform cleaning. Accordingly, in the third embodiment, the sponge roller 75 serving as the cleaning liquid coating member and the backup roller 77 are provided at a belt stretch portion between the rollers that tightly stretches the intermediate transfer belt while the intermediate transfer belt 40 is interposed between the sponge roller 75 and the backup roller 77. In order to float the solids stuck to the intermediate transfer belt, the bias voltage is applied between the rollers 75 and 77 from the power supply 76. As described above, the cleaning liquid coating member is disposed at the belt stretch portion between the rollers that tightly stretch the intermediate transfer belt so as to reduce a pressure against the belt and to uniformly apply the liquid. In addition, the backup roller 77 is provided so as to easily coat the liquid, thereby easily removing the solids stuck to the belt due to the application of the bias voltage. Further, in order to prevent damage to the intermediate transfer belt, the cleaning roller 70, not the cleaning blade, is disposed to face the cleaning backup roller 42. In addition, any liquid including water or the carrier liquid may be used insofar as it can reduce the solid ratio.

Moreover, the sponge roller serving as the liquid coating member, the cleaning roller 70 disposed to face the cleaning backup roller 42, and the blade 71 for cleaning the cleaning roller 70 are the same as those of the first embodiment.

Figure 8:
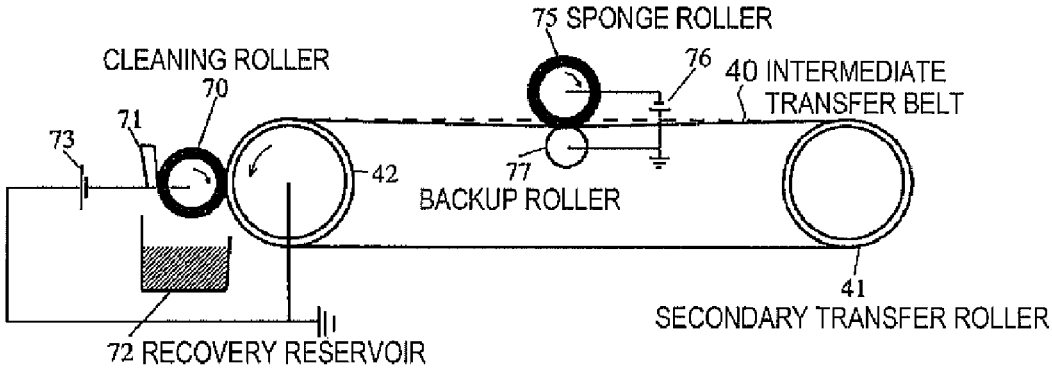
FIG. 8 is a diagram illustrating a fourth embodiment.

FIG. 8 is a diagram illustrating a fourth embodiment. In the fourth embodiment, the intermediate transfer belt is pushed by the sponge roller serving as the cleaning liquid coating member.

The structure of the fourth embodiment is the same as that the third embodiment, except that the sponge roller 75 is shifted toward the center of both the rollers that stretch the intermediate transfer belt from a tangent line (a broken line shown in the drawing) when the intermediate transfer belt is tightly stretched between the cleaning backup roller 42 and the secondary transfer roller 41. As described above, since the sponge roller 75 is shifted inward, a portion of the intermediate transfer belt 40 is pushed by the sponge roller 75, tension is reduced when the sponge roller comes into contact with the belt, and the nip width increases. Thus, the absorption amount of the coating liquid increases. In this case, since the belt is strongly pushed by the sponge roller 75, it is possible to coat the liquid even though the backup roller is omitted. When the backup roller is omitted, the bias voltage is not applied.

Figure 9:
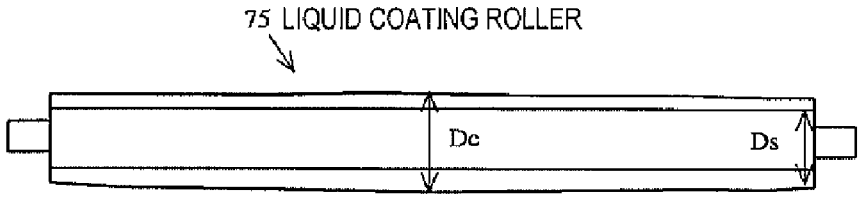
FIG. 9 is a diagram illustrating a liquid coating roller.

FIG. 9 is a diagram illustrating the structure of the coating roller serving as the liquid coating member.

In the liquid coating roller 75, a diameter Dc of the center portion of the liquid coating roller is larger than a diameter of an end portion Ds of the liquid coating roller. Thus, the liquid coating roller has a crown shape. The width of the roller is set to be lower than that of the belt (for example, the width of the roller is 310 mm and the width of the belt is 324 mm). With the above-mentioned structure, the roller or the belt is easily bent, and a contact occurs at the center portion where a contact rarely occurs in the art. Further, good coating is performed at the center portion, and the coated liquid is prevented from falling from the end.

Figure 10:
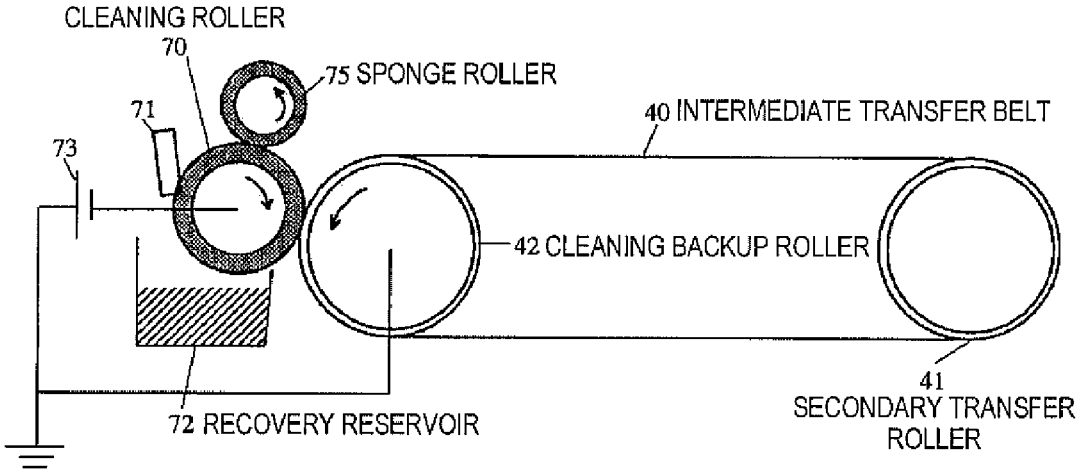
FIG. 10 is a diagram illustrating a fifth embodiment.

FIG. 10 is a diagram illustrating a fifth embodiment. In the fifth embodiment, the sponge roller is used as the liquid coating member 75 and the bias voltage is applied between the cleaning roller 70 and the cleaning backup roller 42.

As described above, the intermediate transfer belt 40 is an endless elastic belt member, and tightly stretched between the secondary transfer roller 41 also serving as the driving roller and the cleaning backup roller 42 also serving as the tension roller. After the secondary transfer, as regards the extraneous material (the liquid developer) that remains on the intermediate transfer belt, since the carrier liquid is removed from the squeeze rollers after the primary transfer and the carrier liquid is absorbed into the transfer member during the secondary transfer, the solid ratio increases. Thus, a strong force is required to perform cleaning, However, when the intermediate transfer belt is cleaned by the blade, if a soft intermediate transfer belt is used, the belt may be damaged. Accordingly, in the fifth embodiment, the cleaning roller is used, instead of the cleaning blade, and the liquid coating member that comes into contact with the cleaning roller is disposed so as to easily perform cleaning, such that cleaning is performed while the liquid is coated on the intermediate transfer belt by the cleaning roller. As the liquid that is coated on the intermediate transfer belt, any liquid including water or the carrier liquid may be used insofar as it can reduce the solid ratio.

Moreover, the sponge roller serving as the liquid coating member, the cleaning roller 70 disposed to face the cleaning backup roller 42, and the blade 71 for cleaning the cleaning roller 70 are the same as those of the first embodiment and the third embodiment. However, a contact to the intermediate transfer belt occurs at the total load of 15 kgf (a linear pressure of 500 kgf) of the sponge roller 75 and the cleaning roller 70.

Figure 11:
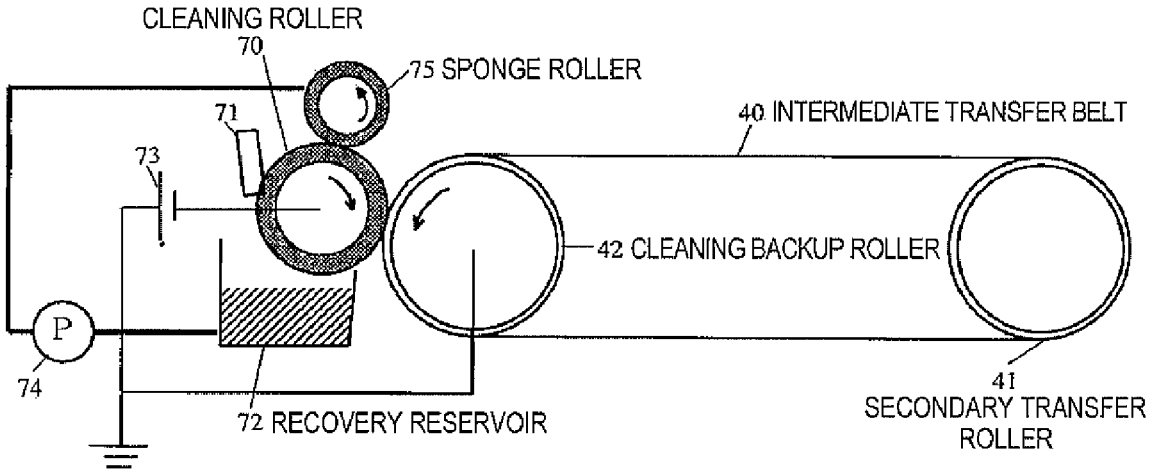
FIG. 11 is a diagram illustrating a sixth embodiment.

FIG. 11 is a diagram illustrating a sixth embodiment. In the sixth embodiment, the liquid that is recovered from the cleaning roller is reused.

The structure of the sixth embodiment is the same as that of the fifth embodiment shown in FIG. 10, except that a waste toner (carrier oil) collected in the recovery reservoir 72 is pumped using the pump 74 and then reused. In the sixth embodiment, the carrier oil that is collected in the recovery reservoir 72 is pumped using the pump 74 and then reused. Thus, cleaning is achieved without using new carrier oil, and carrier oil is prevented from being wasted.

What is claimed is:

1. An image forming apparatus comprising:

an intermediate transfer belt that has an elastic layer to which a toner image on an image carrier developed using a liquid developer is primarily transferred;

a cleaning roller that cleans an extraneous material remaining on the intermediate transfer belt after secondary transfer; and a coating member that coats the intermediate transfer belt with a cleaning liquid, wherein the coating member is disposed on an upstream side of a rotation direction of the intermediate transfer belt with respect to the cleaning roller so as to face a roller that tightly stretches the intermediate transfer belt, and the coating member is disposed to face a secondary transfer roller, and a bias voltage is applied between the coating member and the secondary transfer roller.

2. An image forming apparatus comprising:

an intermediate transfer belt that has an elastic layer to which a toner image on an image carrier developed using a liquid developer is primarily transferred;

a cleaning roller that cleans an extraneous material remaining on the intermediate transfer belt after secondary transfer; and a coating member that coats the intermediate transfer belt with a cleaning liquid, wherein the coating member is disposed on an upstream side of a rotation direction of the intermediate transfer belt with respect to the cleaning roller within a range of a belt stretch portion between rollers that tightly stretch the intermediate transfer belt, and the coating member is a coating roller, and the intermediate transfer belt is wound around the coating roller.

3. An image forming apparatus comprising:

an intermediate transfer belt that has an elastic layer to which a toner image on an image carrier developed using a liquid developer is primarily transferred;

a cleaning roller that cleans an extraneous material remaining on the intermediate transfer belt after secondary transfer; and a coating member that coats the intermediate transfer belt with a cleaning liquid, wherein the coating member is disposed on an upstream side of a rotation direction of the intermediate transfer belt with respect to the cleaning roller within a range of a belt stretch portion between rollers that tightly stretch the intermediate transfer belt, and the coating member is the coating roller, and the coating roller is formed in a crown shape, in which a width of the coating roller is smaller than a width of the intermediate transfer belt, and a diameter of a center portion of the coating roller is larger than a diameter of its end.

* * * * *